US005645912A

United States Patent [19]

Nelson et al.

[11] Patent Number: 5,645,912

[45] Date of Patent: Jul. 8, 1997

[54] ANTI-SKID STAIRCASE TREADS

[76] Inventors: John Robert Nelson, 3, Lorong Galing 71, Taman Air Putih, 25300 Kuantan, Pahang, Malaysia; Richard Forbes Donald-Hill, 43 Jalan Istana, Taman Istana, Ipoh 30000, Perak, Malaysia

[21] Appl. No.: 557,291

[22] Filed: Nov. 14, 1995

[30] Foreign Application Priority Data

Nov. 30, 1994 [MY] Malaysia ..... UI 9403194

[51] Int. Cl.[6] ..... B32B 9/00

[52] U.S. Cl. ..... 428/67; 428/76; 428/91; 428/120; 428/121; 428/148; 428/172; 52/177; 52/179; 52/181; 52/182; 52/188

[58] Field of Search ..... 428/67, 161, 120, 428/121, 261, 76, 148, 91, 172, 245, 284; 52/179, 181, 177, 182, 188

[56] References Cited

U.S. PATENT DOCUMENTS

| | | | |
|---|---|---|---|
| 3,165,641 | 1/1965 | Southern | 248/230 |
| 3,759,000 | 9/1973 | Balzer et al. | 52/179 |
| 3,780,828 | 12/1973 | Overturf | 182/111 |
| 4,151,320 | 4/1979 | Naka | 428/123 |
| 4,469,194 | 9/1984 | McBride | 182/107 |
| 4,600,079 | 7/1986 | McBride | 182/108 |
| 5,103,608 | 4/1992 | Andreo | 52/179 |
| 5,117,941 | 6/1992 | Gruber | 182/107 |
| 5,131,495 | 7/1992 | Bartnicki | 182/124 |
| 5,137,114 | 8/1992 | Yde | 182/49 |
| 5,139,108 | 8/1992 | Pate | 182/129 |
| 5,141,076 | 8/1992 | Joyce | 182/108 |
| 5,141,294 | 8/1992 | Van Zanten | 303/109 |
| 5,154,255 | 10/1992 | Kiska | 182/111 |
| 5,165,641 | 11/1992 | Olsen | 114/362 |
| 5,181,584 | 1/1993 | Simard | 182/201 |
| 5,269,544 | 12/1993 | Park | 280/5.24 |
| 5,316,409 | 5/1994 | Aune | 405/1 |
| 5,339,921 | 8/1994 | Faupel | 182/111 |
| 5,341,899 | 8/1994 | Casamento | 182/205 |
| 5,361,868 | 11/1994 | Bartos | 182/111 |
| 5,377,375 | 1/1995 | Holman | 15/49.1 |
| 5,377,623 | 1/1995 | Parr | 119/221 |

*Primary Examiner*—Patrick Ryan
*Assistant Examiner*—Abraham Bahta
*Attorney, Agent, or Firm*—Ladas & Parry

[57] ABSTRACT

A means to provide a cost effective anti-skid/ anti-slip stairnose in staircases is described. The means can be dimensioned to fit across various lengths of staircases. A detachable anti-skid/ anti-slip conformable tape is fixed onto the stairnoses.

10 Claims, 1 Drawing Sheet

ANTI-SKID STAIRCASE TREADS

The present invention relates to anti-skid staircase treads and in particular to staircase noses which are rendered non-skid.

In prior art various measures to render stairs non-skid are known. In particular measures are taken to render the stairnose non-skid. One such measure includes the provision of ribbed stairnoses. In another measure a horizontal plate which has the upper surface coated with a non-skid composition is secured to the stairnose. All these prior art measures suffer a distinct disadvantage. The wear and tear of a staircase is generally uneven, the greatest amount of wear and tear occurs at the central region of the staircase. As the stairnoses wear off, often the entire staircase is replaced; or where a removable stairnose member is fixed, it is removed and replaced with another similar stairnose member. Such replacements are expensive and generally involves capital expenditure in industries.

In industries where staircases are of the exposed to oil and grease, grilled staircases are often used. Although such grilled staircase steps reduce the possibility of slips, they nevertheless pose a danger at the stairnose region. At the stairnose region anti-slip measures have to be adopted.

Thus it is an object of the present invention to provide anti-slip/ anti-skid stairnose where the anti-slip/ anti skid feature can be maintained at relatively low cost.

It is another object of the present invention to provide a stairnose is a staircase where the stairnose need not be replaced completely when there is wear and tear.

The invention accordingly includes an elongated member for affixing on stairnoses on staircase steps wherein the elongate member includes an anti-slip surfaced conformable tape. The tape is removably but securely affixed onto at least the upper surface thereof. The elongate member is detachably fastened to the staircase steps.

Figure 1A:
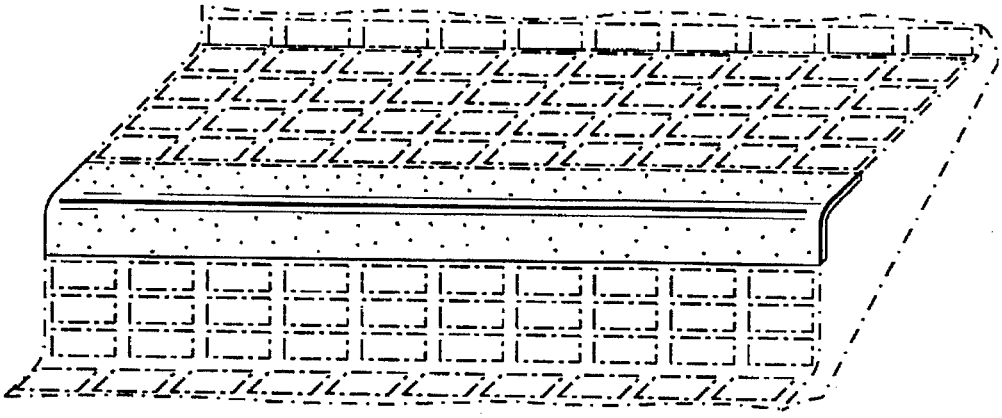
Figure 1B:
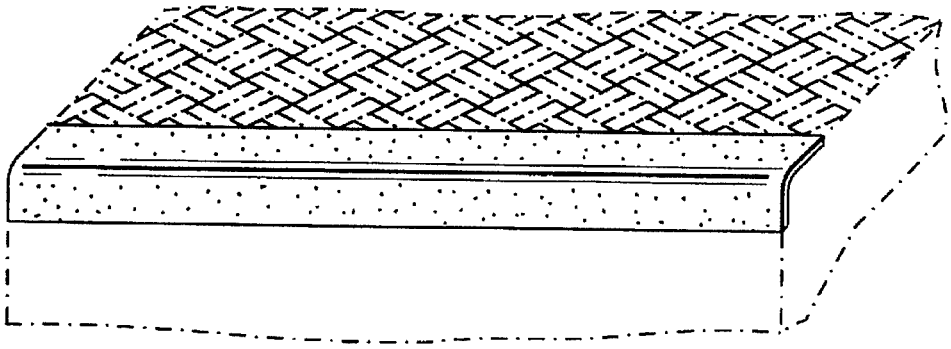

The invention will now be further described by way of example only, with reference to the accompanying drawings, in which:

FIG. 1 (*a*), (*b*) shows prior art stairnose wherein a non-slip composition is applied onto the stairnose which is fixed onto a staircase grided step (*a*), and onto a ribbed stairnose (*b*).

Figure 2:
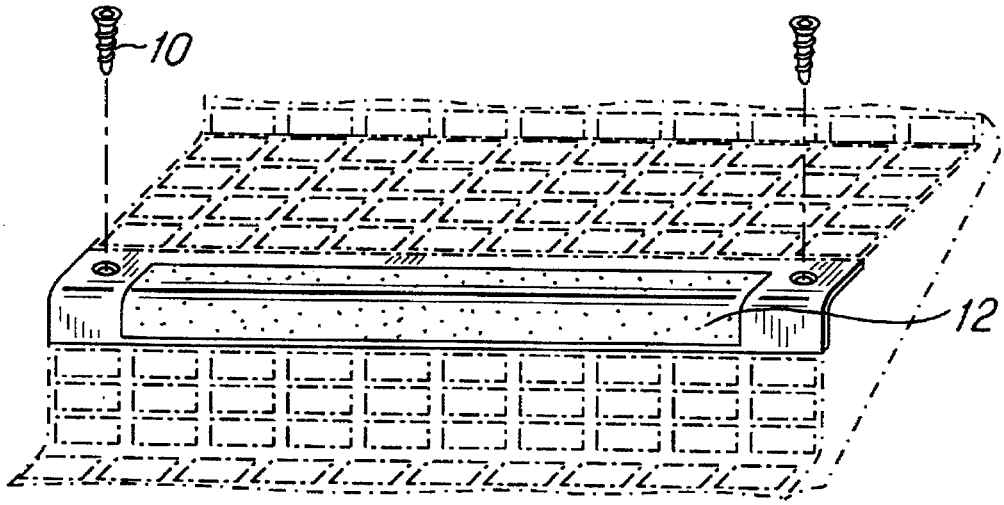

FIG. 2 shows a stairnose wherein a non-slip adhesive layer material is affixed onto the stairnose.

Referring to FIG. 2 there is shown a stairnose member (10), which is angled to fit over a stairnose of an existing staircase. The length of the stairnose member can be dimensioned to fit over a desired staircase. The stairnose member (10) is fixed onto the staircase by any convenient means known to the art. When the stairnose (10) is to be secured to a grid staircase, stainless steel bolts with grating clamps and stainless steel nyloc nuts can be used.

A strip of anti-skid/ anti-slip tape (12) can be secured over the tops surface of the stairnose member and preferably over the front side of the stairnose member. The tape (12) is preferably bright coloured and/or of luminescent colour so as to improve its visibility and to conform to safety regulations. The upper surface of the tape consists of particulate matter securely attached to the tape, so as to provide an anti-skid/ anti-slip surface.

One such example of a commercially available tape is SAFETY-WALK conformable tape manufactured and marketed by 3M corporation. The industrial grade tapes which are available in 6"×60' can be conveniently cut to required size for affixing onto the stairnoses.

In a typical use situation of the invention, the length of the stairnose member (10) is dimensioned to extend across the entire length of the steps in the staircase.

The length of the horizontal surface of the stairnose member is 70 mm, and the length of the vertical surface is 20 mm. The stairnose member is preferably of 1.8–2.0 mm 304 s/s plate angled appropriately. The upper surface consists at least two apertures disposed at the extreme ends. In a preferred embodiment, the apertures are 6 mm (0.25 in) in diameter. A pair of 3/16"×1 ½" SS bolts (roundhead) complete grating clamps and SS nyloc nuts are used to secure the stairnose member onto the staircase.

The Safety-walk conformable tape is cut to the desired size and is fixed to the upper and side surface of the stairnose member (FIG. 2). As the conformable tape is aluminium based, the sharp corner edges are removed so as to eliminate any safety hazard. A sealant is used to secure the tape onto the stairnose member. Preferably a 3M (a trademark of the 3M Corporation) edge sealing compound is applied on tape before securing it to the stairnose member. When the tape is worn out due to wear and tear, it can be removed from the stairnose member, and a new strip of tape can be affixed thereto. The stairnose member can still be utilised as compared to prior art use, where the stairnose member is discarded.

The use of the present invention results in the saving of tremendous cost in industries. The worn out tape and the replacement with a new tape can be done at site, without the need to remove the stairnose members to a different site for the replacement work.

We claim:

1. An anti-skid staircase tread for affixing to a staircase step over the stairnose, which comprises an elongated rigid member angled to fit over the stairnose to conform to the shape of the staircase step, said rigid member having a substantially horizontal portion providing an upper surface and a substantially vertical portion providing a front surface;

a flexible tape dimensioned so as to fit over both upper and front surfaces of the rigid member and having an anti-skid material on the upper surface of said tape; and a sealant applied to the lower surface of the tape for affixing the tape to the rigid member but permitting removal from the rigid member when desired.

2. An anti-skid staircase tread according to claim 1, in which the elongated rigid member is a plate member.

3. An anti-skid staircase tread according to claim 1, wherein the elongated member extends along the entire length of the staircase step.

4. An anti-skid staircase tread according to claim 1, which further comprises means for fastening the elongated rigid member to the staircase step, said fastening means comprising apertures in said member for use with bolt means.

5. An anti-skid staircase tread according to claim 4, in which at least two of said bolt means pass through at least two of said apertures disposed in the horizontal portion of said member at the extreme ends thereof.

6. An anti-skid staircase tread according to claim 4, in which clamps are used to further secure the elongated rigid member to the staircase.

7. An anti-skid staircase tread according to claim 1, in which the flexible tape is spaced from the edges of the elongated member.

8. An anti-skid staircase tread according to claim 1, in which the flexible tape has a bright or luminescent color.

9. An anti-skid staircase tread according to claim 1, wherein the flexible tape comprises aluminum.

10. An anti-skid staircase tread according to claim 1, in which the flexible tape has as the anti-skid material particulate matter securely attached to the upper surface thereof.

* * * * *